US010415921B1

(12) United States Patent
Nousiainen

(10) Patent No.: US 10,415,921 B1
(45) Date of Patent: Sep. 17, 2019

(54) RIFLE REST

(71) Applicant: Nousio, Salo (FI)

(72) Inventor: Jaakko Nousiainen, Salo (FI)

(73) Assignee: Nousio, Salo (FI)

( * ) Notice: Subject to any disclaimer, the term of this patent is extended or adjusted under 35 U.S.C. 154(b) by 0 days.

(21) Appl. No.: 15/911,303

(22) Filed: Mar. 5, 2018

(51) Int. Cl.
*F41A 23/16* (2006.01)
*F41A 23/14* (2006.01)

(52) U.S. Cl.
CPC ..... *F41A 23/16* (2013.01); *F41A 23/14* (2013.01)

(58) Field of Classification Search
CPC ..... F41A 23/16; F41A 23/18
USPC ..... 42/94; 211/64
See application file for complete search history.

(56) References Cited

U.S. PATENT DOCUMENTS

| | | | | |
|---|---|---|---|---|
| 7,216,452 | B1 * | 5/2007 | Hall | F41C 27/22 248/118 |
| 7,980,017 | B2 * | 7/2011 | Harman, III | F41C 27/00 42/94 |
| 2012/0186125 | A1 * | 7/2012 | Werner | F41A 23/18 42/94 |
| 2012/0222344 | A1 * | 9/2012 | Werner | F41A 23/16 42/94 |
| 2014/0082988 | A1 * | 3/2014 | Boll | A01M 31/02 42/94 |
| 2016/0363408 | A1 | 12/2016 | Reed | |
| 2017/0122687 | A1 | 5/2017 | Henderson | |

* cited by examiner

*Primary Examiner* — Reginald S Tillman, Jr.
(74) *Attorney, Agent, or Firm* — Seppo Laine Oy

(57) ABSTRACT

According to an example aspect of the present invention, there is provided a rifle rest comprising a base, a support protruding from the base, a lever which is coupled to the support via a joint, a support element which is connected to the lever, a rifle holder which is coupled to the lever and comprises a pad, and wherein the pad is configured to be moved by changing a position of the support element.

15 Claims, 8 Drawing Sheets

RIFLE REST

FIELD

The present invention relates to a rifle rest.

BACKGROUND

Rifle rests are commonly used, for example, in practise shooting and in benchrest shooting. Recoil from rifles may cause significant movement that reduces the accuracy of a shot. Momentum in the opposite direction to the momentum of the projectile is applied to the firearm during the shot. This momentum may result in significant upward and backward movement of the muzzle. Consequently, a rifle may be placed on a shooting rest to stabilize it during the discharge. The rests themselves may be placed on a stable bench or table and the shooter then may fire the rifle from the rest.

Several rifle rests are known. For example, document US 2016/0363408 A1 teaches a shooting rest. The shooting rest may reduce the recoil, muzzle rise, and shock wave from firing a rifle. A target may remain in the cross hairs while shooting, thus facilitating target memory or easy and fast target re-acquisition. The shooting rest may include a rear support, a front support, a frame, and a lock down bar to secure the front support to a shooting bench or table. The rear support may prevent the muzzle from moving upward and the front support may absorb some of the recoil energy to keep the target in sight. The frame may be secured by the lock down bar and may connect the front support to the table. Additionally, document US 2017/0122687 A1 discloses a gun rest system including a weighted substance and a rifle. A mount is provided and the rifle is positioned on the mount thereby facilitating the mount to restrain the rifle. The mount is substantially hollow such that a selected amount of the weighted substance is positionable within the mount. Thus, the mount absorbs recoil from the rifle when the rifle is fired.

In view of the foregoing it would be beneficial to provide a rifle rest, wherein the aim can be quickly moved across the entire area of a shooting target even at the lowest official benchrest shooting distances. It would be further beneficial to provide additional stability to the rifle rest while shooting according to certain embodiments.

SUMMARY OF THE INVENTION

The invention is defined by the features of the independent claims. Some specific embodiments are defined in the dependent claims.

According to a first aspect of the present invention, there is provided a rifle rest comprising a base, a support protruding from the base, a lever which is coupled to the support via a joint, a support element which is connected to the lever, a rifle holder which is coupled to the lever and comprises a pad, and wherein the pad is configured to be moved by changing a position of the support element.

Various embodiments of the first aspect may comprise at least one feature from the following bulleted list:

- the support element is configured to be moved along the lever
- the support element rests on the base the support element rests on a surface of an object
- the support element comprises a locking mechanism which is configured to be released in order to change the position of the support element along the lever

- the pad is coupled to an upper body which is movable along a first linear guiding
- the upper body is coupled to a lower body which is movable along a second linear guiding and orientated perpendicular to the first guiding
- the pad is configured to be moved in two dimensions by sliding the upper body in a first direction along the first guiding and sliding the lower body in a second direction along the second guiding
- the first linear guiding comprises two first rods which are arranged perpendicular to an upper surface of the base
- the second linear guiding comprises two second rods which are arranged perpendicular to the first rods
- the pad is arranged above an upper body which is arranged above a lower body
- the pad is coupled to the upper body and a part of the lever is coupled to the upper body
- the pad is coupled to an upper body and a part of the lever extends through an opening in the upper body
- the opening is funnel shaped on one side of the upper body and funnel shaped on an opposite side of the upper body
- the rifle rest comprises at least three adjusters configured to adjust a height of the base relative to a surface
- the rifle rest comprises two adjusters configured to adjust an orientation of the base relative to a surface and one spacer configured to position the base at a specific distance from the surface
- the rifle rest comprises at least three adjusters configured to adjust an orientation of the base relative to a surface
- the joint is a ball joint
- the pad is configured to support a rifle during shooting the support element is configured to hold the lever in a defined position to be chosen by a user
- the support element comprises a curved surface configured to be brought into contact with an upper surface of the base
- the rifle rest is configured to allow a user to move an aim across an entire area of a shooting target at a shooting distance of 25 in or more
- the rifle rest is configured to allow a user to move an aim across an entire area of a shooting target at a shooting distance of 2.5 yards or more
- the rifle rest is configured to allow a user to move an aim into a first direction and into a second direction which is perpendicular to the first direction
- the support element comprises a locking mechanism including a member which is configured to be in unlocked position when being pressed by a user
- the support element comprises a breaking mechanism including a member which is configured to be released by activation of a user, for example when being pressed by a user According to a second aspect of the present invention, there is provided a rifle rest comprising a base, a support protruding from the base, a lever which is coupled to the support via a joint, a support element which is connected to the lever, a rifle holder comprising a pad, an upper body and a lower body, and wherein the pad is configured to be moved by sliding the upper body coupled to the pad in a first direction along a first guiding and by sliding the lower body coupled to the upper body in a second direction along a second guiding, and wherein the first direction is perpendicular to the second direction.

Various embodiments of the second aspect may comprise at least one feature corresponding to a feature from the preceding bulleted list laid out in connection with the first aspect.

According to a third aspect of the present invention, there is provided a rifle rest comprising a base, a support which is coupled to the base via a first pivot bearing, a lever which is coupled to the support via a second pivot bearing, a support element which is connected to the lever, and a pad which is configured to be moved by pivoting the support around the first pivot bearing and by pivoting the lever around the second pivot bearing.

Various embodiments of the third aspect may comprise at least one feature corresponding to a feature from the preceding bulleted list laid out in connection with the first aspect.

Considerable advantages are obtained by certain embodiments of the invention. A rifle rest is provided according to certain embodiments of the present invention. By means of certain embodiments of the present invention, increased shooting accuracy and faster operation by quick target acquisition is provided. In particular, the aim can be quickly moved across the entire area of the shooting target even at the lowest official benchrest shooting distances. This is e.g. achieved by the upper body which moves into the first direction and the lower body which moves into the second direction, when moving the lever. A support element is coupled to the lever. The lever can be moved by changing the position of the support element. The support element further holds the lever in a desired position when it rests on an upper surface of the base or a surface of an object. The position of the support element along the lever can be quickly changed by releasing the locking mechanism or the brake.

EMBODIMENTS

Figure 1:
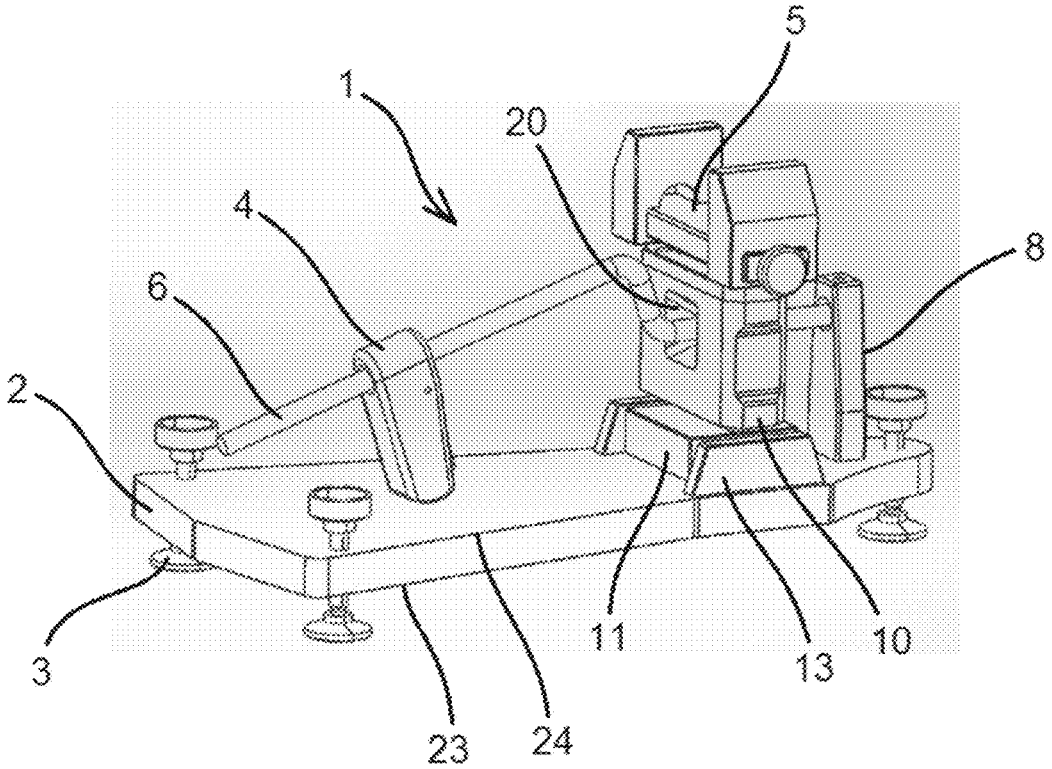
FIG. 1 illustrates a schematic perspective view of a rifle rest in accordance with at least some embodiments of the present invention.

In FIG. 1 a schematic perspective view of a rifle rest 1 in accordance with at least some embodiments of the present invention is illustrated. The rifle rest 1 comprises a base 2 which can be placed on a resting surface of an object (not shown), for example on a stable surface of a table or bench. Typically, the rifle rest 1 comprises a plurality of adjustable legs or adjusters 3, by means of which a vertical distance between said resting surface and the base 2 can be adjusted. Of course, it is also possible to adjust the orientation of the base 2 relative to the resting surface using the adjusters 3. The number of adjusters 3 may be, for example, at least three. According to a certain other embodiment, the rifle rest 1 comprises two adjusters 3 configured to adjust an orientation of the base 2 relative to a surface of an object and one spacer configured to position the base 2 at a specific distance from the surface of the object. The length of the spacer is constant, i.e. not adjustable. Normally, the base 2 is positioned such that the bottom surface 23 of the base 2 is orientated parallel to said resting surface. The base 2 is typically made of any rigid material such as metal, plastics or plywood.

The rifle rest 1 further comprises a lever 6 which is connected to a front support 8. The front support 8 protrudes substantially perpendicular from the upper surface 24 of the base 2, for instance. The lever 6 is connected at one of its ends to the front support 8 by a mechanical joint, for example a cardan joint, an universal joint or a ball joint. The lever 6 is typically in a shape of an extruded part such as a metal bar. On the opposite side of the lever 6 a support element 4 is coupled to the lever 6. The support element 4 is movable along a part of the lever 6. The support element 4 typically rests on the upper surface 24 of the base 2 as shown. The orientation of the lever 6 depends on the position of the support element 4 relative to the front support 8 as well as relative to a longitudinal center axis (not shown) of the base 2.

The lever 6 is coupled to an adapter, i.e. a so called resting pad, support pad, adapter pad 5, or pad, via the upper body 10. A position of the adapter pad 5 can be adjusted by changing a position of the support element 4 relative to the front support 8 and/or to the longitudinal center axis of the base 2. Thus, also an orientation of a rifle (not shown) resting on the adapter pad 5 can be adjusted by changing a position of the support element 4 relative to the front support 8 and/or to the longitudinal center axis of the base 2. When moving the support element 4, and thus the lever 6, to a first side (to the left side) from the longitudinal center axis, the adapter pad 5 moves into the same direction (to the left side), When moving the support element 4, and thus the lever 6, to the other side (to the right side) from the longitudinal center axis, the adapter pad 5 moves into the other direction (to the right side). When moving the support element 4 along the lever 6 towards the front support 8, the adapter pad 5 moves downwards. When moving the support element 4 along the lever 6 from the front support 8 away, the adapter pad 5 moves upwards. The adapter pad 5 may be, for example, a standard pad, a customized pad or an adjustable pad.

The adapter pad 5 is coupled to an upper body 10. The upper body 10 is movable along a first linear guiding 12. The first linear guiding 12 typically comprises two first rods 21 which are orientated in vertical direction, i.e. perpendicular to the upper surface 24 of the base 2. Accordingly, the upper body 10 has two elongate openings within the upper body 10, which openings are configured to correspond to the first rods 21. The first rods are separated from each other and connected to a lower body 11. The lower body 11 is movable along a second linear guiding. The second linear guiding typically comprises two second rods which are orientated in horizontal direction, i.e, perpendicular to the first rods and perpendicular to the longitudinal center axis of the base 2. Accordingly, the lower body 11 has two elongate openings within the lower body 11, which openings are configured to correspond to the second rods. The second rods are separated from each other and connected to two mounting supports 13. The mounting supports 13 protrude from the upper surface 24 of the base 2.

The upper body 10 further comprises an opening 20 through the upper body 10. The opening 20 may be, for example, funnel-shaped on a first side and funnel-shaped on a second side. A part of the lever 6 extends through the opening 20 in the upper body 10 towards the front support 8. A ball joint may be arranged within the opening 20 and the lever 6 may be coupled to the upper body 20 via the ball joint. Thus, the adapter pad 5 can be moved in two dimensions, i.e. in a direction upwards and downwards as well as to the left side and to the right side, by movement of the lever 6 when changing the position of the support element 4.

The adapter pad 5, the upper body 10, the first linear guiding, the lower body 11, the second linear guiding, and the mounting support 13 form a rifle holder on which a rifle can rest during shooting.

Figure 2:
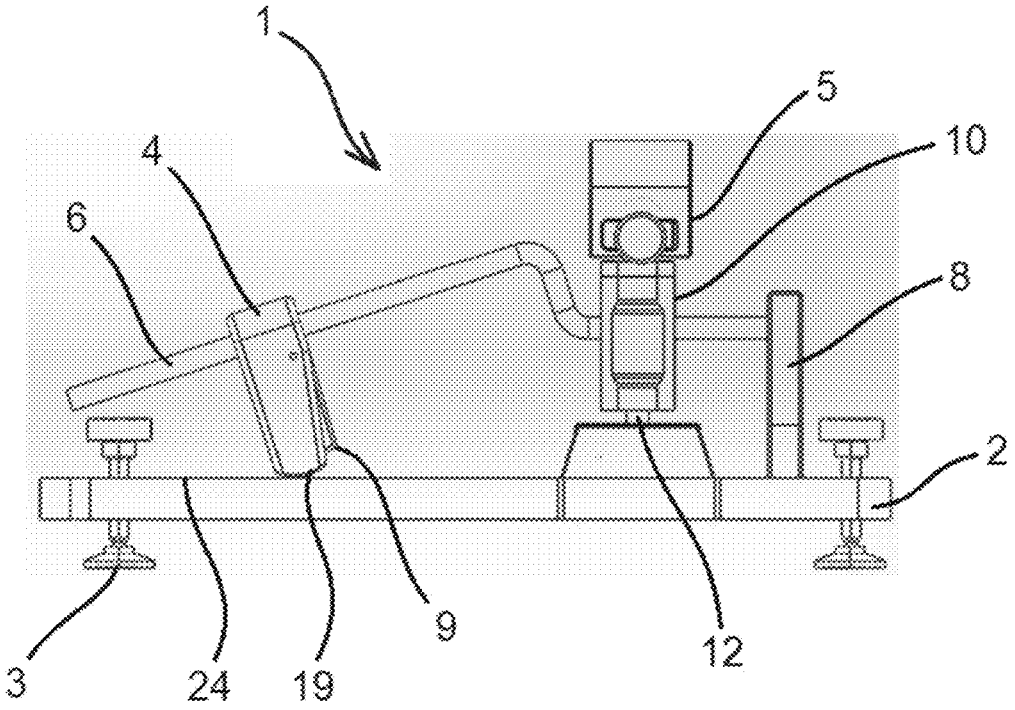
FIG. 2 illustrates a schematic side view of a rifle in accordance with at least some embodiments of the present invention.

In FIG. 2 a schematic side view of a rifle rest 1 in accordance with at least some embodiments of the present invention is illustrated. The rifle rest 1 comprises a base 2, a support 8 protruding from the base 2, a lever 6 which is coupled to the support 8 via a joint, a support element 4 which is connected to the lever 6, a rifle holder which is coupled to the lever and comprises a pad, and wherein the adapter pad 5 is configured to be moved in two dimensions, i.e. in a direction upwards and downwards as well as to the left side and to the right side, by changing a position of the support element 4 on the upper surface 24 of the base 2.

The support element 4 is configured to be moved along a part of the lever 6. The support element 4 rests on the upper surface 24 of the base 2. Thus, the lever 6 can be held in a defined position to be chosen by a user. The support element 4 comprises a curved surface 19 configured to be brought into contact with an upper surface 24 of the base 2. The support element 4 further comprises a locking mechanism 9 which is configured to be released in order to change the position of the support element 4 along the lever 6.

The adapter pad 5 is coupled to an upper body 10 which is movable along a first linear guiding 12. The first guiding is orientated in vertical direction. The upper body 10 is further coupled to a lower body (not visible) which is movable along a second linear guiding (not visible) and orientated perpendicular to the first guiding 12. The second guiding is orientated in a horizontal direction. Thus, the adapter pad 5 can be moved in two dimensions, i.e. in a direction upwards and downwards as well as to the left side and to the right side, by sliding the upper body 10 in a first direction along the first guiding 12 and sliding the lower body in a second direction along the second guiding.

The adapter pad 5 is arranged above the upper body 10 which is arranged above the lower body. Thus, the construction can hold the weight of a rifle to be placed on the adapter pad 5. The adapter pad 5 is configured to support a rifle (not shown) during shooting.

The rifle rest 1 comprises adjusters 3 configured to adjust a height of the base 2 relative to a surface (not shown), for example a surface of a table or bench. Of course, it is also possible to adjust an orientation of the base 2 relative to a surface. Typically, the base 2 is arranged parallel or substantially parallel to the surface.

Figure 3:
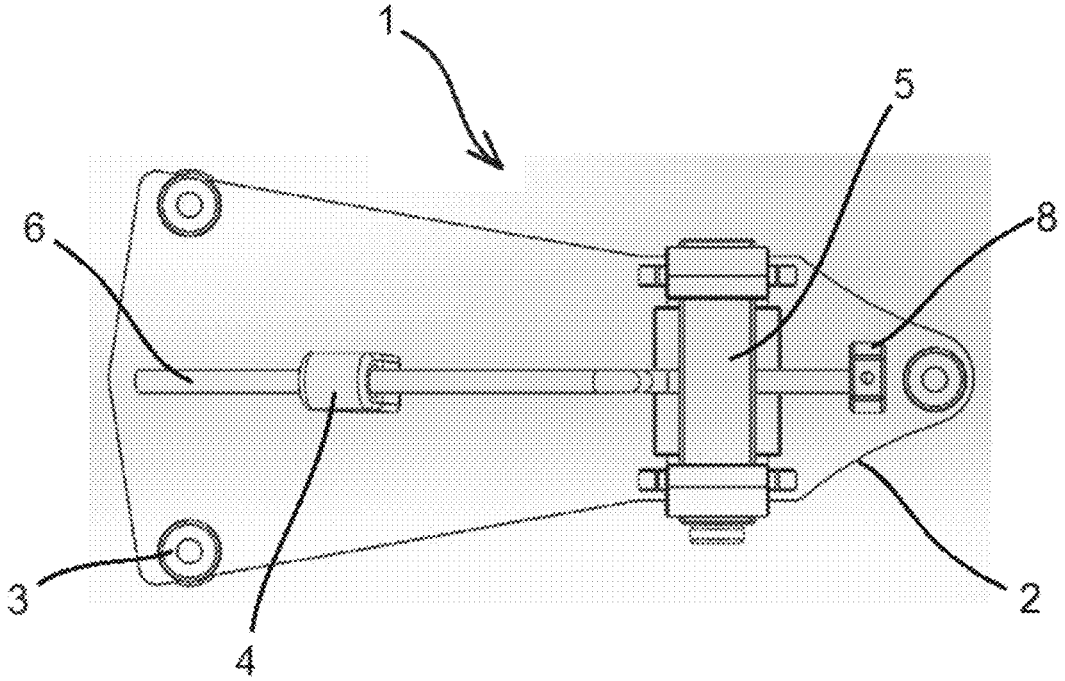
FIG. 3 illustrates a schematic top view of a rifle rest in accordance with at least some embodiments of the present invention.

In FIG. 3 a schematic top view of a rifle rest 1 in accordance with at least some embodiments of the present invention is illustrated. The rifle rest 1 comprises a base 2, a support 8 protruding from the base 2, a lever 6 which is coupled to the support 8 via a joint, a support element 4 which is connected to the lever 6, a rifle holder which is coupled to the lever and comprises a pad, and wherein the adapter pad 5 is configured to be moved in two dimensions, i.e. in a direction upwards and downwards as well as to the left side and to the right side, by changing a position of the support element 4.

The position of the support element 4 can be changed by either sliding the support element 4 along the lever 6 or by positioning the support element 4 to the left or right side from a longitudinal central axis (not shown) of the base 2. Thus, quick target acquisition can take place.

Even at a minimum shooting distance of 25 m or 25 yards it is possible to aim at a target from the left side of the target to the right side of the target due to the possibility of moving the support element 4 from the longitudinal center axis of the base 2 away, thus simultaneously moving the adapter pad 5 on Which the rifle rests. In other words, it is not only possible to aim at a part of a target at the minimum shooting distance, but it is further possible to aim at all parts of the target at the minimum shooting distance. The aim can be quickly moved across the entire area of the shooting target even at the lowest official benchrest shooting distances.

Figure 4:
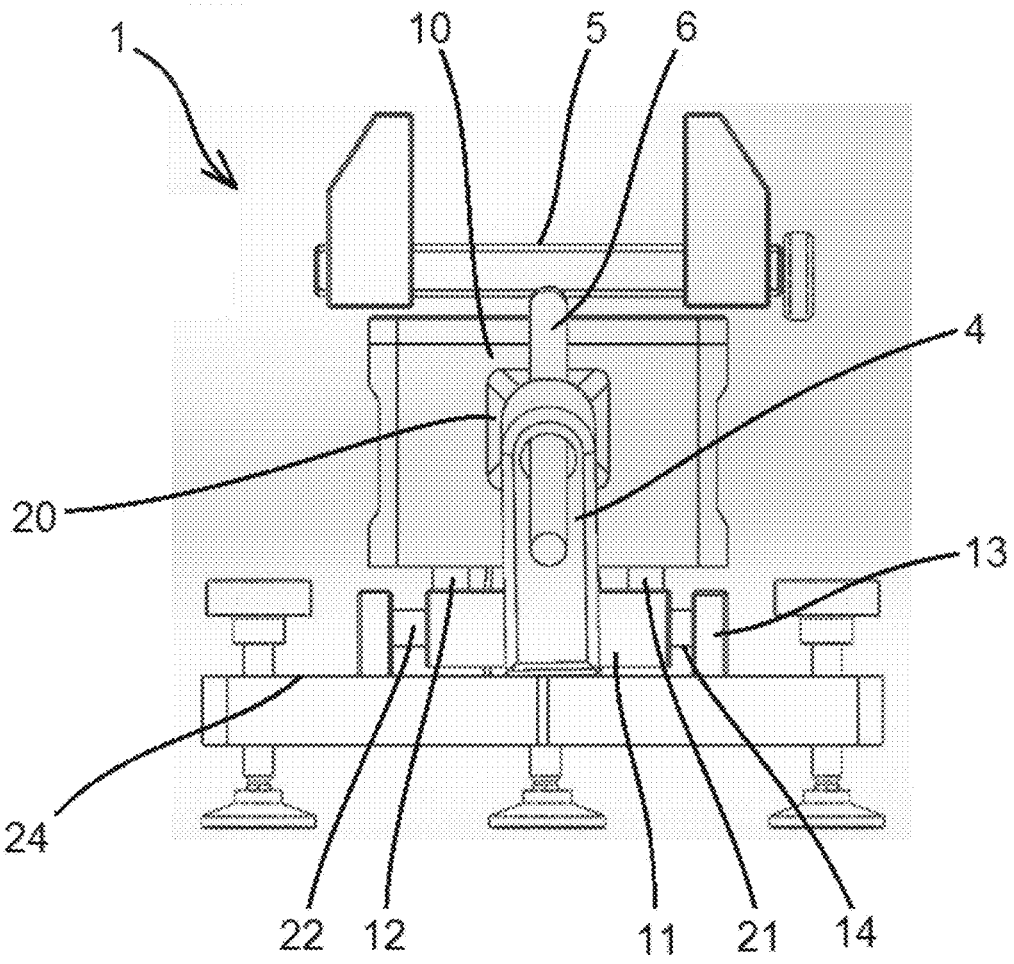
FIG. 4 illustrates a schematic rear view of a rifle rest in accordance with at least some embodiments of the present invention.

In FIG. 4 a schematic rear view of a rifle rest 1 in accordance with at least some embodiments of the present invention is illustrated. The rifle rest 1 comprises a base 2, a support 8 protruding from the base 2, a lever 6 which is coupled to the support 8 via a joint, a support element 4 which is connected to the lever 6, a rifle holder which is coupled to the lever and comprises a pad, and wherein the adapter pad 5 is configured to be moved in two dimensions, i.e. in a direction upwards and downwards as well as to the left side and to the right side, by changing a position of the support element 4.

Two mounting supports 13, which are separated from each other, protrude in vertical direction from the upper surface 24 of the base 2. A lower body 11 is movable in horizontal direction along a linear guiding 14 provided between the mounting supports 13. The adapter pad 5 can be moved to the left or right side by moving the support element 4 to the respective side of the base 2 away from the longitudinal center axis (not shown) of the base 2.

The upper body 10 is movable along another linear guiding 12 in vertical direction. The adapter pad 5 can be moved upwards or downwards by moving the support element 4 along the lever 6.

Consequently, the adapter pad 5 is configured to be moved in one dimension or in two dimensions, i.e. in a direction upwards and downwards and/or to the left side and to the right side, by changing a position of the support element 4.

It can be seen that the support element 4 comprises an opening or boring in the upper region of the support element 4. A part of the lever 6 extends through the opening or boring. The support element 4 further comprises a curved surface 19 in the lower region of the support element 4. Thus, the support element 4 can rest on the upper surface 24 of the base 2 regardless of the respective position along the lever 6.

Figure 5:
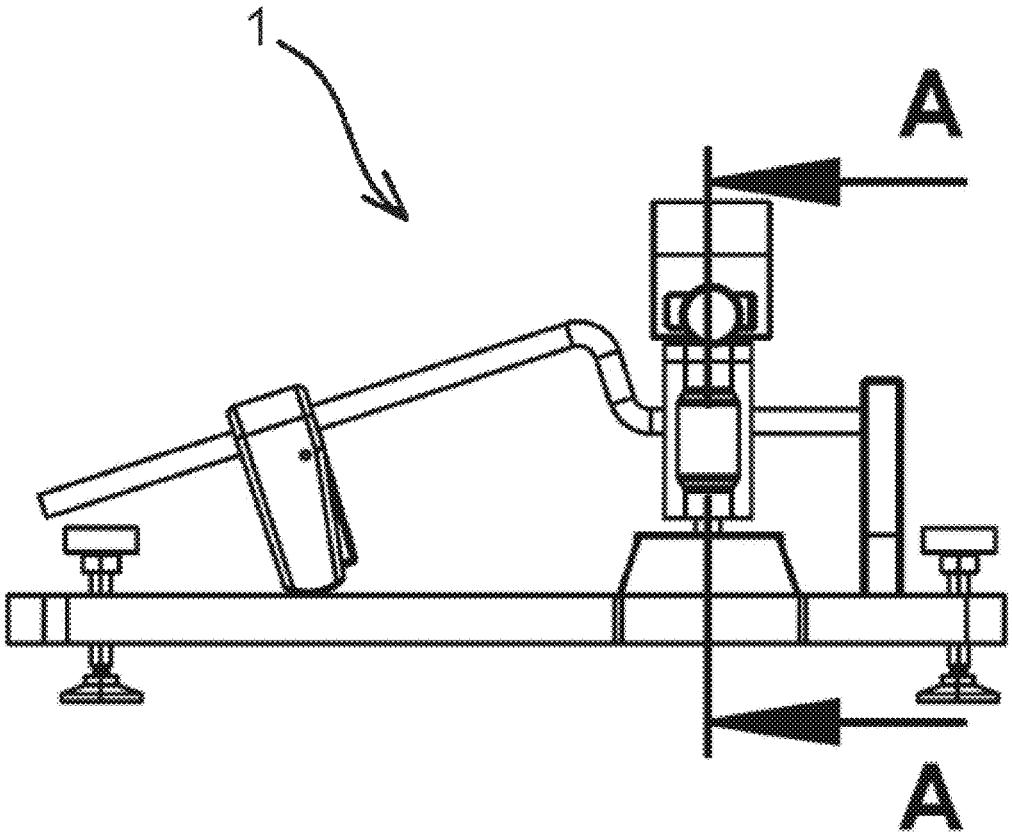
FIG. 5 illustrates a schematic side view of another rifle rest in accordance with at least some embodiments of the present invention.

In FIG. 5 a schematic side view of another rifle rest 1 in accordance with at least some embodiments of the present invention is illustrated. Intersecting line A-A is shown in the figure.

Figure 6:
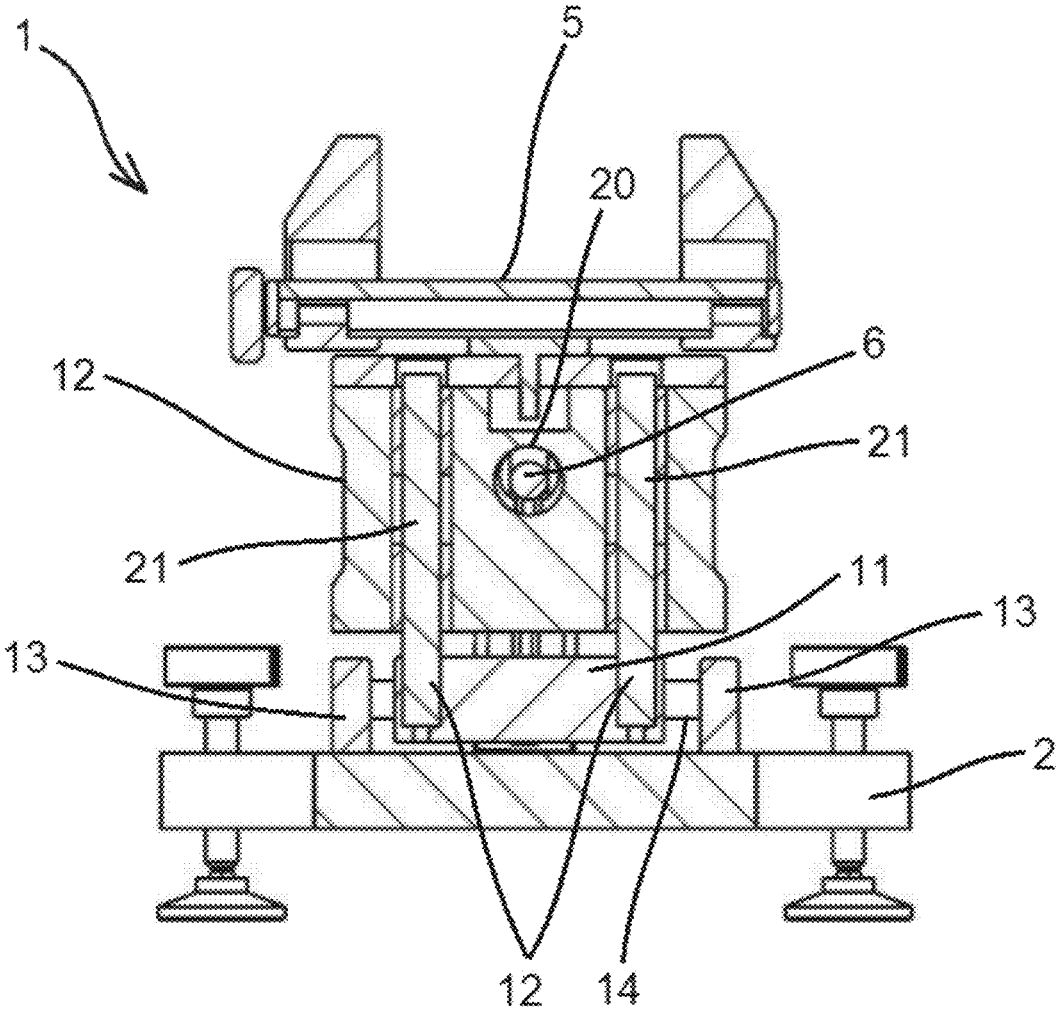
FIG. 6 illustrates a schematic view of a cross section along intersecting line A-A of a rifle rest in accordance with at least some embodiments of the present invention.

In FIG. 6 a schematic view of a cross section along intersecting line A-A of a rifle rest 1 in accordance with at least some embodiments of the present invention is illustrated. It can be seen that the first linear guiding 12 comprises first rods 21 which are connected to the lower body 11 and protrude from the lower body 11 in vertical direction. The upper body 10 comprises two elongate openings which are separated from each other. The position of said openings is aligned with the position of the first rods 21. Thus, the upper body 10 can be slided upwards or downwards when changing the position of the support element 4 along the lever 6, which extends through another opening in the upper body 10.

Figure 7:
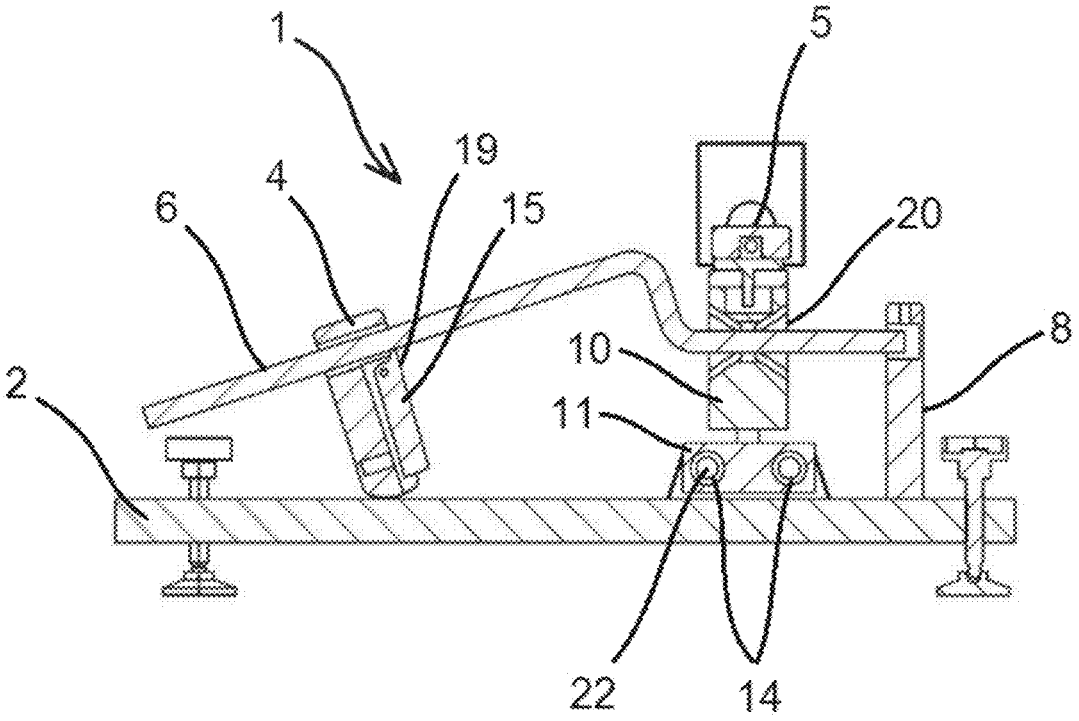
FIG. 7 illustrates a schematic view of another cross section of a rifle rest in accordance with at least some embodiments of the present invention.

In FIG. 7 a schematic view of another cross section of a rifle rest 1 in accordance with at least some embodiments of the present invention is illustrated. A cross section along the longitudinal center axis of the base 2 is shown.

It can be seen that the support element 4 comprises a breaking mechanism 19 which can be released by activation of a user in order to move the support element 4 along the lever 6. The breaking mechanism 19 may, for example, comprise a member 15 which is rotatable around an axis of rotation and which comprises a tooth. In the locked position, the tooth of the member 15 is brought into contact with the surface of the lever, thus preventing the support element 4 from moving along the lever 6. The member 15 of the breaking mechanism 19 can be e.g. pressed in order to release the breaking mechanism 19. In such a case, the tooth of the member 15 is not in contact with the surface of the lever 6 anymore and the support element 4 can be moved along the lever 6. The breaking mechanism 19 may further comprise a spring, for example a coil spring, in order to bring the member 15 into the breaking position when not being pressed by a user.

It can be additionally seen that the lever 6 extend through an opening 20 in the upper body 10. Said opening 20 is formed such that there is arranged a first funnel-shaped portion on one side of the upper body 10 and a second funnel-shaped portion on the other side of the upper body 10. In the center of the upper body 10, the smaller cross-sectional areas of the two funnel-shaped portions of the opening 20 are connected to each other. A ball joint may be arranged within the opening 20. The larger cross-sectional areas of the two funnel-shaped portions are arranged on the sides of the upper body 10, respectively. The smaller cross-sectional area of each funnel-shaped portion of the opening 20 is substantially the same as the cross-sectional area of the lever 6. When changing the position of the support element 4 to one side of the base 2, i.e, away from the longitudinal center axis of the base 2, the lever 6 can change its orientation within the upper body 10 due to the larger cross-sectional areas of the two funnel-shaped portions of said opening 20 through the upper body 10, while at the same time the lower body 11, which is coupled to the upper body 10, is pushed to the respective side along the linear guiding 14. The linear guiding 14 comprises two rods 22 which are separated from each other. The rods 22 are inserted into respective openings or borings through the lower body 11.

It can be furthermore seen that the lever 6 is coupled to a front support 8 at one of its ends. Typically, the lever 6 is coupled to the front support 8 via a cardan joint, an universal joint or a ball joint (not shown).

Figure 8:
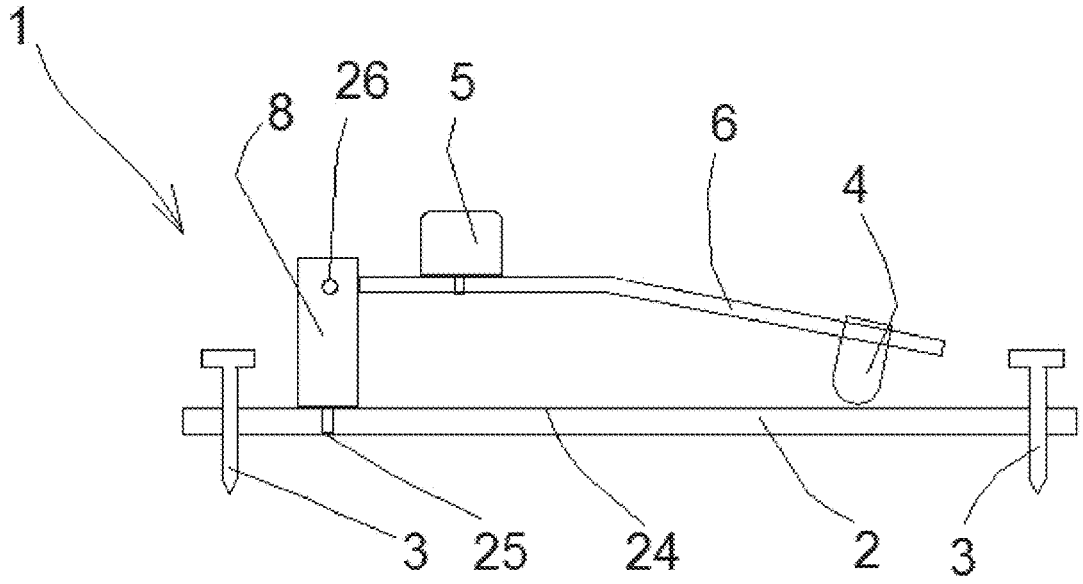
FIG. 8 illustrates a schematic side view of another rifle rest in accordance with at least some embodiments of the present invention.

In FIG. 8 a schematic side view of another rifle rest 1 in accordance with at least some embodiments of the present invention is illustrated. The rifle rest 1 comprises a base 2 and a support 8 which is coupled to the base 2 via a first pivot bearing 25. Thus, it is possible to pivot or rotate the support 8 around the axis of the first pivot bearing 25. The axis of the first pivot 25 bearing is orientated in vertical direction. The rifle rest 1 further comprises a lever 6 which is coupled to the support 8 via a second pivot bearing 26. Thus, it is possible to pivot or rotate the lever 6 around the axis of the second pivot bearing 26. The axis of the second pivot bearing 26 is orientated in horizontal direction, i.e. perpendicular to the axis of the first pivot bearing 25. The rifle rest 1 furthermore comprises a support element 4 which is connected to the lever 6 and rests on an upper surface 24 of the base 2. Additionally, the rifle rest 1 comprises an adapter pad 5 which is configured to be moved in two planes by pivoting the support 8 around the axis of the first pivot bearing 25 and by pivoting the lever 6 around the axis of the second pivot bearing 26. The adapter pad 5 is connected to the lever 6. The adapter pad 5 is configured to be moved in two planes by changing a position of the support element on the upper surface 24 of the base 2.

Figure 9:
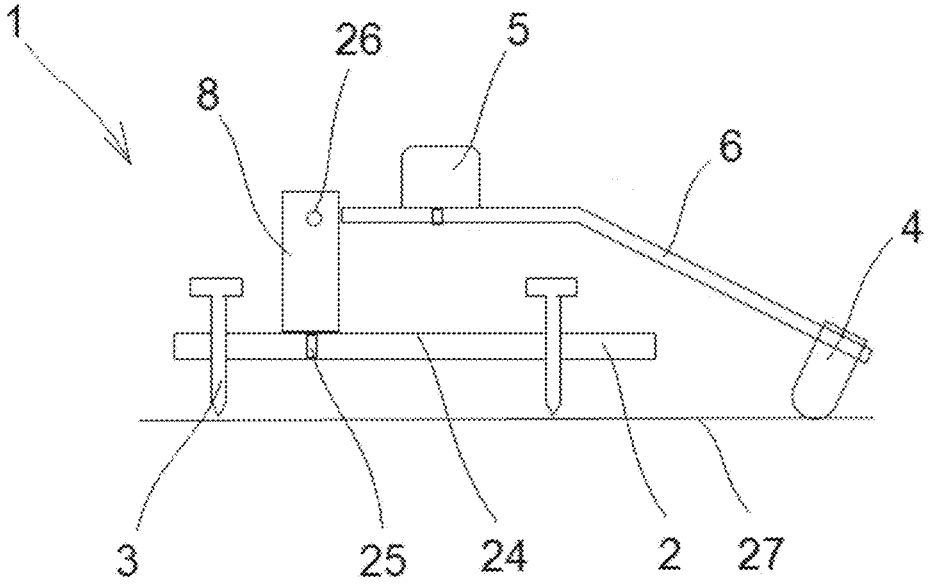
FIG. 9 illustrates a schematic side view of a further rifle rest in accordance with at least some embodiments of the present invention.

In FIG. 9 a schematic side view of a further rifle rest 1 in accordance with at least some embodiments of the present invention is illustrated. The rifle rest 1 comprises a base 2 and a support 8 which is coupled to the base 2 via a first pivot bearing 25. Thus, it is possible to pivot or rotate the support 8 around the axis of the first pivot bearing 25. The axis of the first pivot 25 bearing is orientated in vertical direction. The rifle rest 1 further comprises a lever 6 which is coupled to the support 8 via a second pivot bearing 26. Thus, it is possible to pivot or rotate the lever 6 around the axis of the second pivot bearing 26. The axis of the second pivot bearing 26 is orientated in horizontal direction, i.e. perpendicular to the axis of the first pivot bearing 25. The rifle rest 1 furthermore comprises a support element 4 which is connected to the lever 6 and rests on a surface of another object 27. Additionally, the rifle rest 1 comprises an adapter pad 5 which is configured to be moved in two planes by pivoting the support 8 around the axis of the first pivot bearing and by pivoting the lever 6 around the axis of the second pivot bearing 26. The adapter pad 5 is connected to the lever 6. The adapter pad 5 is configured to be moved in two planes by changing a position of the support element on the surface of the object 27.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in production of rifle rests.

REFERENCE SIGNS LIST

1 rifle rest
2 base
3 adjuster
4 support element
5 adapter pad
6 lever
7 first joint
8 front support
9 locking mechanism
10 upper body
11 lower body
12 first linear guiding
13 mounting support
14 second linear guiding
15 member
16 ball joint
17 break
18 spring
19 curved surface
20 opening
21 first rods
22 second rods
23 bottom surface
24 upper surface
25 first pivot bearing
26 second pivot bearing
27 object

CITATION LIST

Patent Literature

US 2017/0122687 A1
US 2016/0363408 A1

The invention claimed is:

1. A rifle rest comprising:
a base,
a front support protruding from the base,
a lever coupled to the front support with one of its ends via a joint,
a support element connected to the lever and configured to move along the lever,
a rifle holder which is coupled to the lever between the front support and the support element, wherein the rifle holder comprises a pad and an upper body which is arranged above a lower body, and wherein the pad is coupled to the upper body and a part of the lever is coupled to the upper body or the pad is coupled to the upper body and a part of the lever extends through an opening in the upper body, and wherein
the rifle holder is configured to be moved by changing a position of the support element.

2. The rifle rest according to claim 1, wherein the support element rests on the base or on a surface of an object.

3. The rifle rest according to claim 1, wherein the support element comprises a locking mechanism which is configured to be released in order to change the position of the support element along the lever.

4. The rifle rest according to claim 1, wherein
the pad is coupled to an upper body of the rifle holder which is movable along a first linear guiding, and
the upper body is coupled to a lower body which is movable along a second linear guiding and orientated perpendicular to the first guiding.

5. The rifle rest according to claim 4, wherein the pad is configured to be moved in two dimensions by sliding the upper body in a first direction along the first guiding and sliding the lower body in a second direction along the second guiding.

6. The rifle rest according to claim 4, wherein
the first linear guiding comprises two first rods which are arranged perpendicular to an upper surface of the base, and
the second linear guiding comprises two second rods which are arranged perpendicular to the first rods.

7. The rifle rest according to claim 1, wherein the opening is funnel shaped on one side of the upper body and funnel shaped on an opposite side of the upper body.

8. The rifle rest according to claim 1, wherein the rifle rest comprises at least three adjusters configured to adjust at least one of a height of the base relative to a surface and an orientation of the base relative to a surface or the rifle rest comprises two adjusters configured to adjust an orientation of the base relative to a surface and one spacer configured to position the base at a specific distance from the surface.

9. The rifle rest according to claim 1, wherein the joint is a ball joint.

10. The rifle rest according to claim 1, wherein the pad is configured to support a rifle during shooting.

11. The rifle rest according to claim 1, wherein the support element is configured to hold the lever in a defined position to be chosen by a user.

12. The rifle rest according to claim 1, wherein the support element comprises a curved surface configured to be brought into contact with an upper surface of the base.

13. The rifle rest according to claim 1, wherein the rifle rest is configured to allow a user to move an aim across an entire area of a shooting target at a shooting distance of 25 m or more or the rifle rest is configured to allow a user to move an aim across an entire area of a shooting target at a shooting distance of 25 yards or more.

14. The rifle rest according to claim 1, wherein the rifle rest is configured to allow a user to move an aim into a first direction and into a second direction which is perpendicular to the first direction.

15. The rifle rest according to claim 1, wherein the support element comprises a locking mechanism including a member which is configured to be in unlocked position by activation of a user or the support element comprises a breaking mechanism including a member which is configured to be released by activation of a user.

* * * * *